US005433542A

United States Patent [19]

Masuda et al.

[11] Patent Number: 5,433,542

[45] Date of Patent: Jul. 18, 1995

[54] DEVICE FOR CONTROLLING PRINTING POSITION

[75] Inventors: Kazuya Masuda, Nara; Kunihiro Kobayashi, Soraku; Kohichi Sumida, Nara, all of Japan

[73] Assignee: Sharp Kabushiki Kaisha, Osaka, Japan

[21] Appl. No.: 186,785

[22] Filed: Jan. 25, 1994

[30] Foreign Application Priority Data

Jan. 27, 1993 [JP] Japan ..... 5-011742

[51] Int. Cl.[6] ..... B41J 19/14

[52] U.S. Cl. ..... 400/279; 341/15

[58] Field of Search ..... 400/279, 322, 320; 341/15

[56] References Cited

U.S. PATENT DOCUMENTS 5,168,274 12/1992 Wakamatsu ..... 341/15

5,291,133 3/1994 Gokhale ..... 341/15

FOREIGN PATENT DOCUMENTS 60-161160 8/1985 Japan ..... 400/279

*Primary Examiner*—David A. Wiecking
*Assistant Examiner*—Steven S. Kelley
*Attorney, Agent, or Firm*—David G. Conlin; Robert F. O'Connell; Brian Michaelis

[57] ABSTRACT

The control device is characterized by including a linear encoder for storing two pieces of information on two phases about a printing position in one storing part located on a longitudinal axis of the linear encoder, reading means for reading the pieces of information on two phases stored in the storing part of the linear encoder, and control circuits for controlling a printing position based on the informations on two phases read by the reading means.

2 Claims, 2 Drawing Sheets

DEVICE FOR CONTROLLING PRINTING POSITION

BACKGROUND OF THE INVENTION

1. Field of the Invention

The present invention relates to a device for controlling a printing position which device is used for a printer device, and more particularly to the device for controlling a printing position which device provides a control circuit so that the control circuit may control one linear encoder to store two pieces of information about an absolute position at a magnetization period of a minimum resolution and an integer-fold magnetization period of a minimum resolution for controlling the printing position in the printer.

The present device may be used for an ink-jet printer, a thermal printer, a facsimile, or a wire-dot printer.

2. Description of the Related Art

FIG. 3 is a view showing a conventional linear encoder for storing two pieces of information on two phases. FIG. 4 is a schematic section showing the linear encoder shown in FIG. 3.

In FIGS. 3 and 4, 1 denotes a linear encoder (magnetic memory type). 2 denotes a linear encoder element (MR head unit). 3 denotes a first sensing head for sensing a printing position. 4 denotes a second sensing head for sensing a carriage position. 5 denotes a first magnetizing part for storing information about a printing position. 6 denotes a second magnetizing part for storing information about a carriage position. 7 denotes a magnetic memory part. 8 denotes a slide metal. The linear encoder stores the information about printing position at the first magnetizing part 5 and the information about a carriage position at the second magnetizing part 6, the first magnetizing part 5 being different in pitch from the second magnetizing part 6, that is, two kinds of informations being stored in two storage parts located on the longitudinal axis of the linear encoder. The two kinds of position information are sensed by the first and the second sensing elements provided in the slide metal 8 of the MR head part 2, respectively.

As mentioned above, the conventional linear encoder is required to keep a considerable degree of accuracy about sensing positions around the slide metal so that the first sensing head may match in position to the first magnetizing part and the second sensing head may match in position to the second magnetizing part for obtaining the position information.

Further, for the first and the second magnetizing parts, that is, for sensing the stored informations on two phases, the first and the second two heads are required, which results in making the overall device more costly.

SUMMARY OF THE INVENTION

It is an object of the present invention to provide a device for controlling a printing position which is capable of sensing two pieces of information on two phases at one sensing operation and with one sensing element.

The object of the invention can be achieved by a device for controlling a printing position comprising a linear encoder for storing two pieces of information on two phases about a printing position in one storage part located on a longitudinal axis of the linear encoder, reading means movably located along the storage part of the linear encoder and for reading the pieces of information on two phases stored in the storage part of the linear encoder, and control circuits for controlling the printing position based on the informations on two phases read by the reading means.

In the device for controlling a printing position according to the present invention, the linear encoder stores the two pieces of information on two phases about a printing position in one storage part located on the longitudinal axis. Hence, the informations on two phases are allowed to be read by just one reading means, which makes it possible to manufacture a device for controlling a printing position at low cost.

The linear encoder stores informations on two phases about a printing position in one storage part located on a longitudinal axis of the linear encoder. Hence, the informations on two phases are allowed to be read by one reading means, so that the device for controlling a printing position may be manufactured at low cost.

Further objects and advantages of the present invention will be apparent from the following description of the proffered embodiments of the invention as illustrated in the accompanying drawings.

DESCRIPTION OF THE PREFERRED EMBODIMENT

Figure 1:
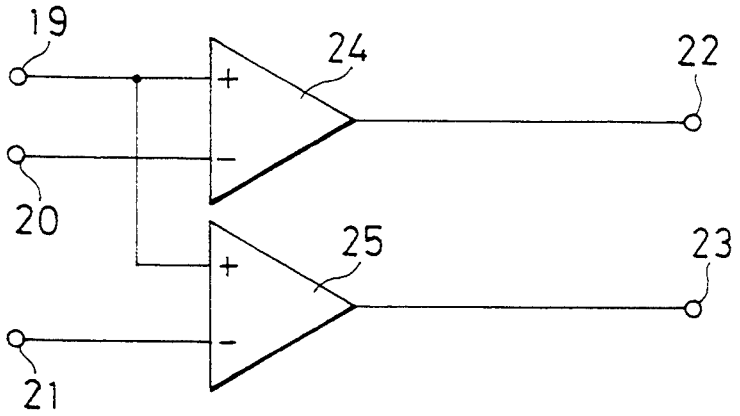
FIG. 1 is a diagram showing a control circuit according to an embodiment.
Figure 2:
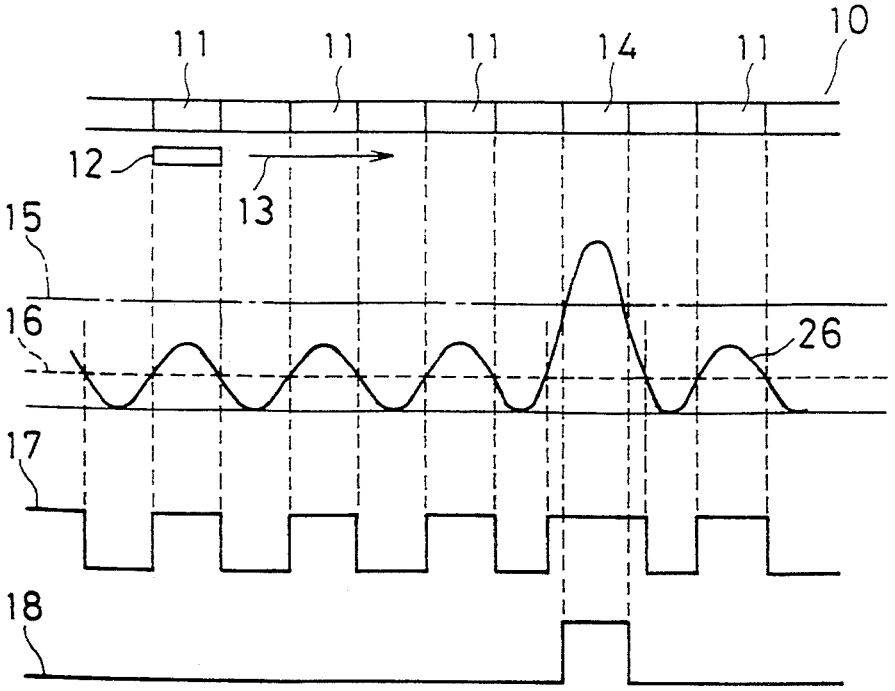
FIG. 2 is a view for explaining reading of information from a linear encoder for storing informations on two phases.
Figure 3:
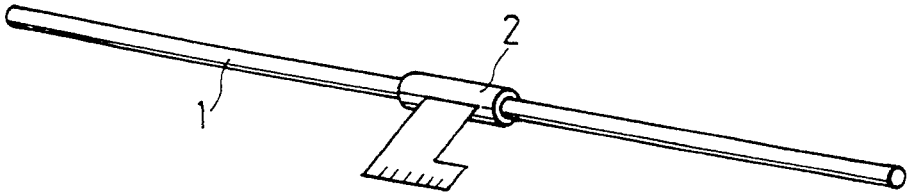
FIG. 3 is a view for explaining a conventional linear encoder for storing information on two phases.
Figure 4:
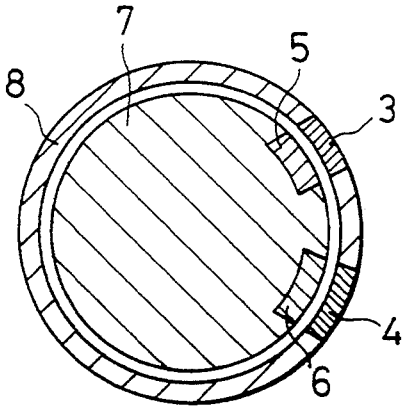
FIG. 4 is a schematic section showing the linear encoder shown in FIG. 3.

FIG. 1 is a diagram showing a control circuit for controlling two pieces of information on two phases. FIG. 2 is a view for explaining reading of positional information from the linear encoder having the informations about a printing position and, a carriage position stored (magnetized) thereon.

In FIG. 2, 10 denotes one storage part located on a longitudinal axis of a linear encoder. 11 denotes a magnetizing (storing) part for storing information about a printing position at a magnetizing period of a minimum resolution. 12 denotes an MR head served as reading means. 13 denotes a magnetizing (storing) part for storing information about a carriage position stored at an integer-fold magnetizing period of a minimum resolution. 26 denotes a waveform of a signal read by the MR head 2 served as reading means. 17 denotes a waveform of a signal corresponding to the magnetizing part 11. 18 denotes a waveform of a signal at the magnetizing part 14. 15 denotes a threshold value about the magnetizing part 14. 16 denotes a threshold value about the magnetizing part 11.

In FIG. 2, one of the informations on two phases is stored in the magnetizing part 11 and the other is stored in the magnetizing part 14 at an integer-fold interval from the normal magnetizing part 11. The force of magnetization provided in the magnetizing part 14 is stronger than that provided in the magnetizing part 11. When the MR head 12 is moved toward an arrow 13, the output signal 16 corresponding to the magnetizing parts 11 and 14 is allowed to be obtained.

In FIG. 1, 24 and 25 denote comparators having respective threshold values. The signal 26 generated as the MR head is moved from the terminal 19 to the comparators 24 and 25 is inputted to the comparators 24 and 25 respectively. The comparator 24 holds a threshold value 16 set through the terminal 20 and the comparator 25 holds a threshold value 15 set through the terminal 21. When the signal 26 is inputted to both of the comparators 24 and 25, if the signal 26 is higher than each of their threshold values, that is, if the signal 26 is higher than the threshold value 16, the signal 17 is outputted at the output terminal 22 of the comparator 24 and if the signal 26 is higher than the threshold value 15, the signal 18 is outputted at the output terminal 28 of the comparator 25. Hence, the information about a printing position is obtained on the magnetizing part 11 and the information about a carriage position is obtained on the magnetizing part 14.

As described above, the control of the printing position and the carriage position based on the information magnetized in one storing part of one linear encoder along one travel of one MR head are allowed to be realized with a simple arrangement and at low cost. The magnetizations on two phases are done once so as to keep a phase difference between the two phases highly accurate.

Many widely different embodiments of the present invention may be constructed without departing from the spirit and the scope of the present invention. It should be understood that the present invention is not limited to the specific embodiments described in the specification, except as defined in the appended claims.

What is claimed is:

1. A device for controlling a printing position, comprising:

a magnetic memory type linear encoder for storing pieces of information on two phases about a printing position in a single linear storage part provided thereon and arranged parallel to a longitudinal axis of said linear encoder;

a single reading head movably located along said single linear storage part on said linear encoder with a single linear arrangement of magnetizing parts at a magnetizing period of a minimum resolution and at an integer-fold magnetizing period of said minimum resolution, and for reading said pieces of information on two phases stored in said single linear storage part, and control circuits for controlling a printing position based on said pieces of information on two phases read by said single reading head, wherein said single reading head outputs an output signal representative of said information on two phases, and wherein said control circuit includes a first comparator connected to receive said output signal and first threshold values for outputting a signal representative of first information about a printing position based on said integer-fold magnetizing period of said minimum resolution and a second comparator connected to receive said output signal and second threshold values smaller than said first threshold value for outputting a signal representative of second information about a printing position based on the magnetization period of said minimum resolution.

2. A device for controllong a printing position as claimed in claim 1, wherein force of magnetization about information stored at the integer-fold magnetizing period of said minimum resolution is larger than force of magnetization about information stored at the magnetization period of said minimum resolution.

* * * * *